US011052291B2

(12) United States Patent
Kuwahara

(10) Patent No.: US 11,052,291 B2
(45) Date of Patent: Jul. 6, 2021

(54) GOLF BALL

(71) Applicant: BRIDGESTONE SPORTS CO.,LTD., Tokyo (JP)

(72) Inventor: Masanobu Kuwahara, Chichibu (JP)

(73) Assignee: BRIDGESTONE SPORTS CO., LTD., Tokyo (JP)

( * ) Notice: Subject to any disclaimer, the term of this patent is extended or adjusted under 35 U.S.C. 154(b) by 0 days.

(21) Appl. No.: 17/063,720

(22) Filed: Oct. 6, 2020

(65) Prior Publication Data

US 2021/0170238 A1 Jun. 10, 2021

(30) Foreign Application Priority Data

Dec. 9, 2019 (JP) ..... JP2019-222275

(51) Int. Cl.
*A63B 37/06* (2006.01)
*A63B 37/00* (2006.01)

(52) U.S. Cl.
CPC ..... *A63B 37/0096* (2013.01); *A63B 37/0006* (2013.01); *A63B 37/0012* (2013.01); *A63B 37/0075* (2013.01)

(58) Field of Classification Search
CPC ..... A63B 37/009
USPC ..... 473/378
See application file for complete search history.

(56) References Cited

U.S. PATENT DOCUMENTS

2006/0116221 A1* 6/2006 Watanabe ..... A63B 37/0003 473/371
2010/0062876 A1* 3/2010 Shinohara ..... A63B 37/009 473/376
2011/0136590 A1 6/2011 Kim et al.

FOREIGN PATENT DOCUMENTS

JP 2011120612 A 6/2011

* cited by examiner

*Primary Examiner* — Raeann Gorden
(74) *Attorney, Agent, or Firm* — Kenja IP Law PC

(57) ABSTRACT

The golf ball 1 includes a surface having multiple dimples thereon. When a lift coefficient measured under conditions with a Reynolds number of 80000 and a spin rate of 2000 rpm is CL1, and when a lift coefficient measured under conditions with a Reynolds number of 70000 and a spin rate of 1900 rpm is CL2, CL1 and CL2 satisfy 0.990≤CL2/CL1.

4 Claims, 8 Drawing Sheets

GOLF BALL

TECHNICAL FIELD

The present disclosure relates to a golf ball.

This application is based on and claims priority to Japanese patent application No. 2019-222275, filed on Dec. 9, 2019, the entire content of which is incorporated herein by reference.

BACKGROUND

Golf balls have undergone improvement in dimple shapes to increase flight distance (for example, Patent Literature 1)

CITATION LIST

Patent Literature

PTL 1: JP 2011-120612 A

SUMMARY

However, existing techniques leave room for further increase in the flight distance.

It would be helpful to provide a golf ball capable of improving the flight distance.

A golf ball according to an embodiment of the present disclosure includes a surface having multiple dimples thereon, wherein, when a lift coefficient measured under conditions with a Reynolds number of 80000 and a spin rate of 2000 rpm is CL1, and when a lift coefficient measured under conditions with a Reynolds number of 70000 and a spin rate of 1900 rpm is CL2, CL1 and CL2 satisfy $$0.990 \leq CL2/CL1.$$

In the golf ball according to a preferred embodiment, when a lift coefficient measured under conditions with a Reynolds number of 200000 and a spin rate of 2500 rpm is CL3, and when a lift coefficient measured under conditions with a Reynolds number of 120000 and a spin rate of 2250 rpm is CL4, CL3 and CL4 satisfy $$1.250 \leq CL4/CL3 \leq 1.280.$$

In the golf ball according to another preferred embodiment,

CL1 is not less than 0.230 and not more than 0.240, and

CL2 is not less than 0.230 and not more than 0.240.

In the golf ball according to still another preferred embodiment,

CL3 is not less than 0.145 and not more than 0.155, and

CL4 is not less than 0.185 and not more than 0.195.

The present disclosure provides a golf ball that can increase the flight distance.

BRIEF DESCRIPTION OF THE DRAWINGS

In the accompanying drawings:

FIG. 5A and FIG. 5B illustrate golf balls according to Example 4, with

FIG. 5A viewed from the pole side, and with FIG. 5B viewed from the seam side;

DETAILED DESCRIPTION

Figure 1:
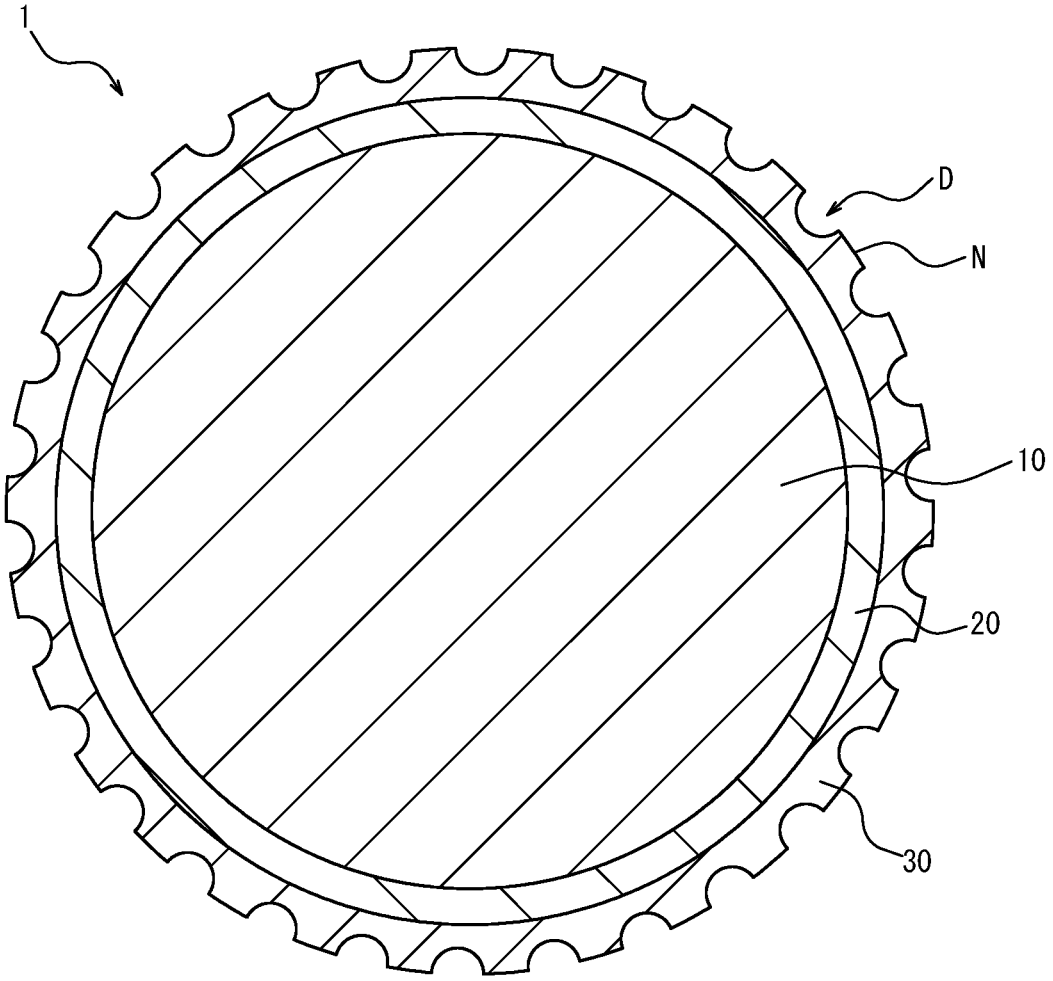
FIG. 1 is a sectional view schematically illustrating a golf ball according to an embodiment of the present disclosure.
Figure 2:
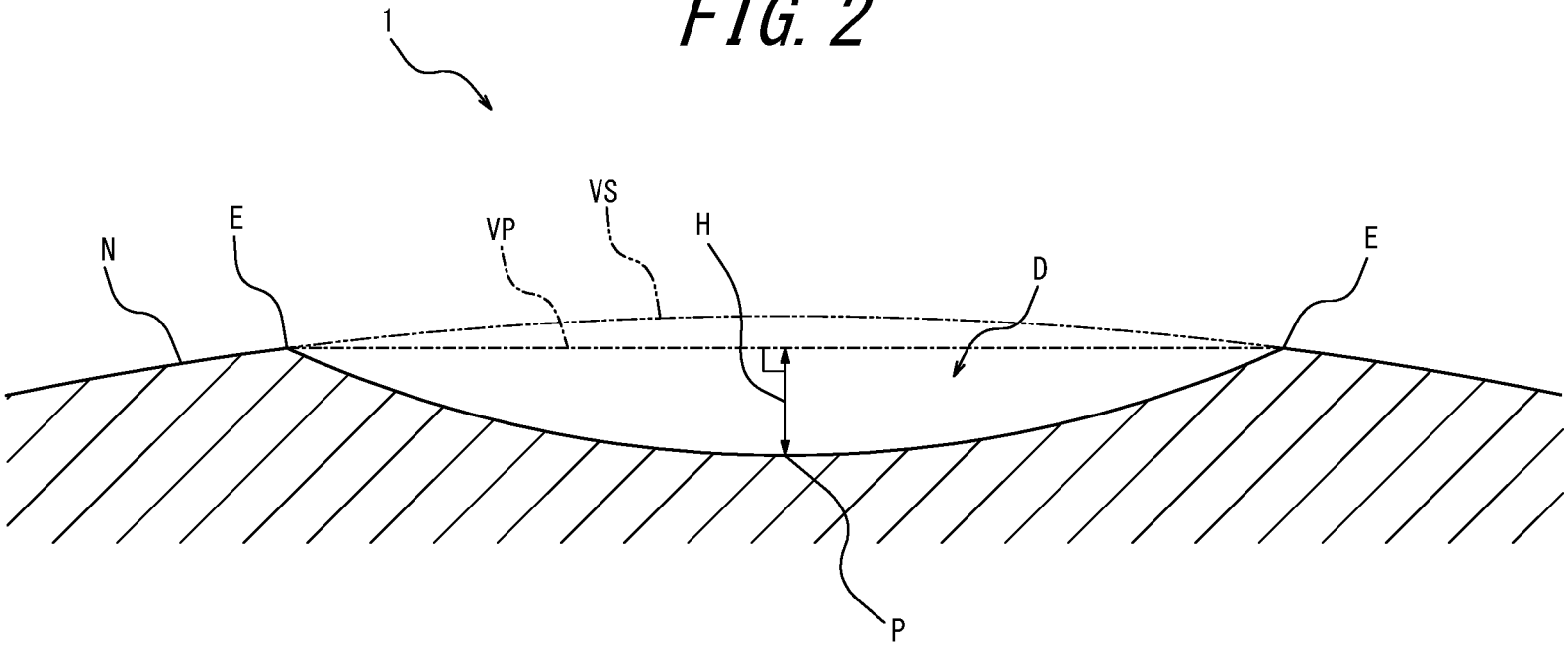
FIG. 2 is a sectional view schematically illustrating part of the golf ball of FIG. 1.

Hereinafter, embodiments of a golf ball according to the present disclosure will be described by way of illustration with reference to FIGS. 1 and 2. FIG. 1 is a sectional view (that is, a sectional view taken along a plane passing through a center of the golf ball, which similarly applies hereinafter) schematically illustrating a golf ball according to an embodiment of the present disclosure. FIG. 2 is a sectional view schematically illustrating part of the golf ball of FIG. 1.

Same components in the figures are assigned with same reference numerals.

As in the example of FIGS. 1 and 2, a golf ball 1 according to any embodiment of the present disclosure includes a surface having multiple dimples D thereon. Part of the surface of the golf ball 1 other than the dimples D is a land N.

The golf ball 1 according to any embodiment of the present disclosure may include any internal configuration. The golf ball 1 according to any embodiment of the present disclosure may be configured as a one-piece golf ball, a two-piece golf ball, or a multi-piece golf ball having a three or more layered-structure (e.g., a three-piece golf ball, a four-piece golf ball, a five-piece golf ball, a six-piece golf ball, etc.).

The golf ball 1 according to any embodiment of the present disclosure may be configured as a solid golf ball or a thread-wound golf ball.

As in the example of FIG. 1, the golf ball 1 according to any embodiment of the present disclosure may include one or more layers of core 10 and a cover 30 disposed on an outer side in a circumferential direction of the one or more layers of core 10. The golf ball 1 according to any embodiment of the present disclosure may further include one or more intermediate layers 20 disposed on the outer side in the circumferential direction of the one or more layers of core 10 and on an inner side in the circumferential direction of the cover 30.

In the golf ball 1 according to any embodiment of the present disclosure, when a lift coefficient measured under conditions with a Reynolds number of 80000 and a spin rate of 2000 rpm is CL1, and when a lift coefficient measured under conditions with a Reynolds number of 70000 and a spin rate of 1900 rpm is CL2, the lift coefficient CL1 and the lift coefficient CL2 satisfy $$0.990 \leq CL2/CL1.$$

Herein, the "coefficients of lift (CL1, CL2, CL3, and CL4)" are measured in accordance with Indoor Test Range (ITR) defined by the United States Golf Association (USGA).

The coefficients of lift may be controlled by adjusting the configurations (arrangement, diameter, depth, volume, number, shape, etc.) of the dimples D of the golf ball 1. The coefficients of lift are independent of the internal configuration of the golf ball 1.

The Reynolds numbers (Re) are dimensionless numbers used in the field of fluid mechanics. The Reynolds numbers (Re) are each calculated by the following Equation (1).

$$Re=\rho vL/\mu \quad (1)$$

In Equation (1), p represents density of a fluid, v represents an average velocity of an object relative to fluid flow, L represents a characteristic length, and μ represents a coefficient of viscosity of the fluid. Generally speaking, the Reynolds number of 80000 and the spin rate of 2000 rpm, that is, the condition under which the aforementioned lift coefficient CL1 is measured, basically corresponds to a state when the lift coefficient of the golf ball starts to decrease (and thus the golf ball starts to fall) after the golf ball has been launched and reached a highest point. Also, generally speaking, the Reynolds number of 70000 and the spin rate of 1900 rpm, that is, the condition under which the aforementioned lift coefficient CL2 is measured, basically corresponds to a state immediately before the golf ball falls to the ground after the golf ball has been launched and reached the highest point. Additionally, these apply especially when the golf ball is launched under a high-speed condition (e.g., with an initial speed of 72 m/s, a spin rate of 2500 rpm, and a launch angle of 10°). The high-speed condition corresponds to a condition under which advanced amateurs and professional golfers launch a golf ball.

In the golf ball 1 according to any embodiment of the present disclosure, as described above, satisfying $$0.990 \le CL2/CL1$$

restrains the decrease in the lift coefficient during the fall of the golf ball 1, thus helping increase the flight distance in the fall (and thus increase a carry) and increase a run. The result is an increase in the flight distance (total). If CL2/CL1 is less than 0.990, the golf ball 1 is likely to fall suddenly, thereby creating difficulty in sufficiently increasing the carry and the run. Additionally, these apply especially when the golf ball is launched under the high-speed condition (e.g., with the initial speed of 72 m/s, the spin rate of 2500 rpm, and the launch angle of 10°).

From a similar perspective, the lift coefficient CL1 and the lift coefficient CL2 preferably satisfy $$0.995 \le CL2/CL1,$$

more preferably satisfy $$0.999 \le CL2/CL1,$$

and even more preferably satisfy $$1.018 \le CL2/CL1.$$

From the perspective of increasing the flight distance, higher the ratio CL2/CL1, the better it is. For example, the lift coefficient CL1 and the lift coefficient CL2 may satisfy $$CL2/CL1 \le 1.100$$

or may satisfy $$CL2/CL1 \le 1.050$$

or may satisfy $$CL2/CL1 \le 1.044$$

or may satisfy $$CL2/CL1 \le 1.022.$$

In the examples described herein, in the golf ball 1, when a lift coefficient measured under conditions with a Reynolds number of 200000 and a spin rate of 2500 rpm is CL3, and when a lift coefficient measured under conditions with a Reynolds number of 120000 and a spin rate of 2250 rpm is CL4, CL3 and CL4 preferably satisfy $$1.250 \le CL4/CL3.$$

Generally speaking, the Reynolds number of 200000 and the spin rate of 2500 rpm, that is, the condition under which the aforementioned lift coefficient CL3 is measured, basically corresponds to a state immediately after the golf ball is launched under the high-speed condition (e.g., with the initial speed of 72 m/s, the spin rate of 2500 rpm, and the launch angle of 10°). Also, generally speaking, the Reynolds number of 120000 and the spin rate of 2250 rpm, that is, the condition under which the above-described lift coefficient CL4 is measured, basically corresponds to a state after approximately two seconds of rising has passed since the launching of the golf ball under the high-speed condition (e.g., with the initial speed of 72 m/s, the spin rate of 2500 rpm, and the launch angle of 10°).

As described above, with the lift coefficient CL3 and the lift coefficient CL4 satisfying $$1.250 \le CL4/CL3,$$

the golf ball 1, when launched under the high-speed condition (e.g., with the initial speed of 72 m/s, the spin rate of 2500 rpm, and the launch angle of 10°), is ensured to achieve a sufficient amount of rise, and this in turn restrains dropping and increases the carry. The result is an increase in the flight distance (total).

From a similar perspective, the lift coefficient CL3 and the lift coefficient CL4 preferably satisfy $$1.252 \le CL4/CL3.$$

In the examples described herein, in the golf ball 1, the lift coefficient CL3 and the lift coefficient CL4 preferably satisfy $$CL4/CL3 \le 1.280.$$

This prevents the golf ball 1, when launched under the high-speed condition (e.g., with the initial speed of 72 m/s, the spin rate of 2500 rpm, and the launch angle of 10°), from achieving an excessive amount of rise (and thus preventing blow-up), thereby increasing resistance to wind and increasing the carry. The run can also be increased. The result is an increase in the flight distance (total).

In the examples described herein, in the golf ball 1, the lift coefficient CL3 and the lift coefficient CL4 preferably satisfy $$1.250 \le CL4/CL3 \le 1.280.$$

This increases the flight distance (total).

In the examples described herein, from the perspective of increasing the flight distance, the lift coefficient CL1 is preferably not less than 0.230. The lift coefficient CL1 is preferably not more than 0.240.

From the similar perspective, the lift coefficient CL2 is preferably not less than 0.230. The lift coefficient CL2 is preferably not more than 0.240.

From the similar perspective, the lift coefficient CL3 is preferably not less than 0.145. The lift coefficient CL3 is preferably not more than 0.155.

From the similar perspective, the lift coefficient CL4 is preferably not less than 0.185. The lift coefficient CL4 is preferably not more than 0.195.

In the examples described herein, the shape of a dimple D in a plan view thereof may be freely-selected. For example, the shape of the dimple D in the plan view may be circular (e.g., circular as in the example of FIG. 3), polygonal (e.g., polygonal as in the example of FIG. 5), tear dropped, elliptical, etc.

In the examples described herein, a sectional shape of a dimple D in a section passing through the center of the golf ball 1 and a center of the dimple D may be freely selected. For example, the sectional shape of the dimple D may be a curved shape (e.g., a shape formed by a substantially arc-like curve as in the example of FIG. 2), a wave shape, or a shape combining a curve and a straight line.

Note that the "center of the dimple (D)" herein refers to a point in points on a wall surface of the dimple (D) that is located at a center of gravity of the shape of the dimple (D) in the plan view thereof.

In the examples described herein, an arrangement pattern of the dimples D may be freely selected. Examples of arrangement patterns that may be suitably employed may include a geometric arrangement pattern of a regular polyhedron, such as a regular octahedron, a regular dodecahedron, or a regular icosahedron, and an arrangement pattern having rotational symmetry about a pole of the golf ball 1, such as four-fold symmetry, five-fold symmetry, or six-fold symmetry. This allows the dimples D to be arranged uniformly with high symmetry.

In the above regard, the geometric arrangement pattern of a regular polyhedron refers to any arrangement pattern obtained by arranging, when the regular polyhedron is projected to be inscribed inside a sphere assumed as a golf ball, one or more dimples D on a surface portion of the golf ball that is located on an outer side in a radial direction of any one of surfaces of the regular polyhedron, and arranging the one or more dimples D on each of surface portions of the golf ball that are located on the outer side in the radial direction of the remaining surfaces of the regular polyhedron, similarly to the surface portion of the golf ball that is located on the outer side in the radial direction of the one surface (so that the arrangement of the one or more dimples D is identical to that on the surface portion of the golf ball that is located on the outer side in the radial direction of the one surface). Additionally, the one or more dimples D may be located on boundaries between adjacent surface portions of the golf ball that are located on the outer side in the radial direction of adjacent surfaces of the regular polyhedron, only if the arrangement of the one or more dimples D is identical in all the surface portions of the golf ball that are located on the outer side in the radial direction of all the surfaces of the regular polyhedron.

In the examples described herein, from the perspective of increasing the flight distance, preferably two or more types of the dimples D, more preferably three or more types of the dimples D, with different diameters, depths, volumes, and/or shapes may be formed on the golf ball 1. Further, not more than 50 types, not more than 35 types, not more than 10 types, or not more than 8 types of the dimples D with different diameters, depths, volumes, and/or shapes may be formed on the golf ball 1.

In the examples described herein, from the perspective of increasing the flight distance, a diameter of a dimple D having a smallest diameter in the multiple dimples D included in the golf ball 1 may be, but is not particularly limited to, preferably not less than 2.00 mm, more preferably not less than 2.50 mm, and even more preferably not less than 2.70 mm. Similarly, from the perspective of increasing the flight distance, a diameter of a dimple D having a largest diameter in the multiple dimples D included in the golf ball 1 may be, but is not particularly limited to, preferably not more than 6.50 mm, more preferably not more than 5.50 mm, and even more preferably not more than 5.00 mm.

Note that the diameter of a dimple D refers to a diameter of a circle having an area equal to an area within a contour of the dimple D, provided that the contour of the dimple D is non-circular.

Figure 7:
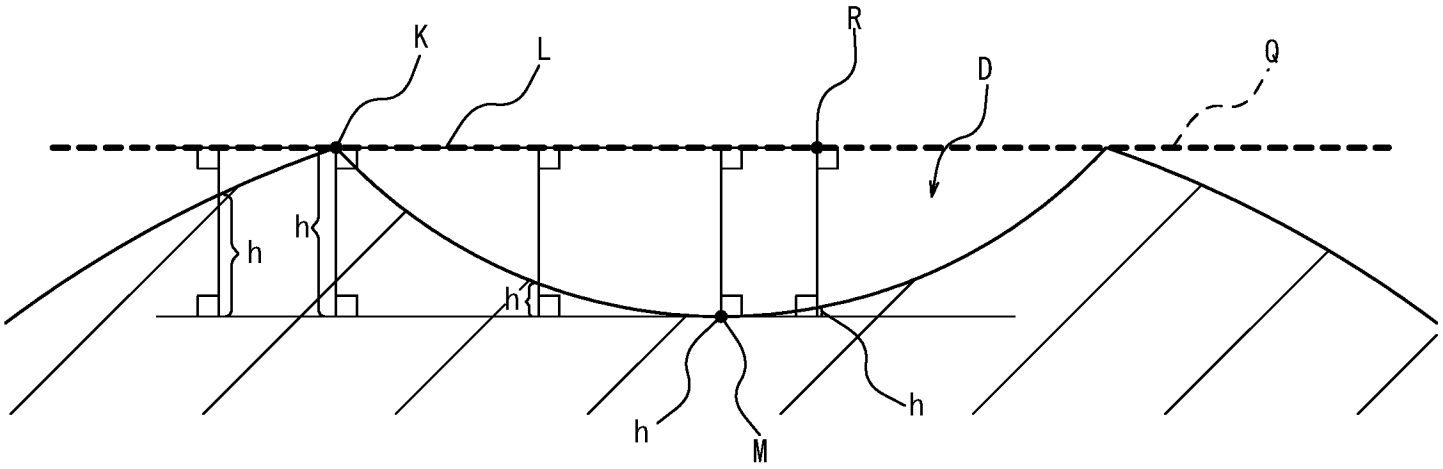
FIG. 7 illustrates a dimple contour.
Figure 8:
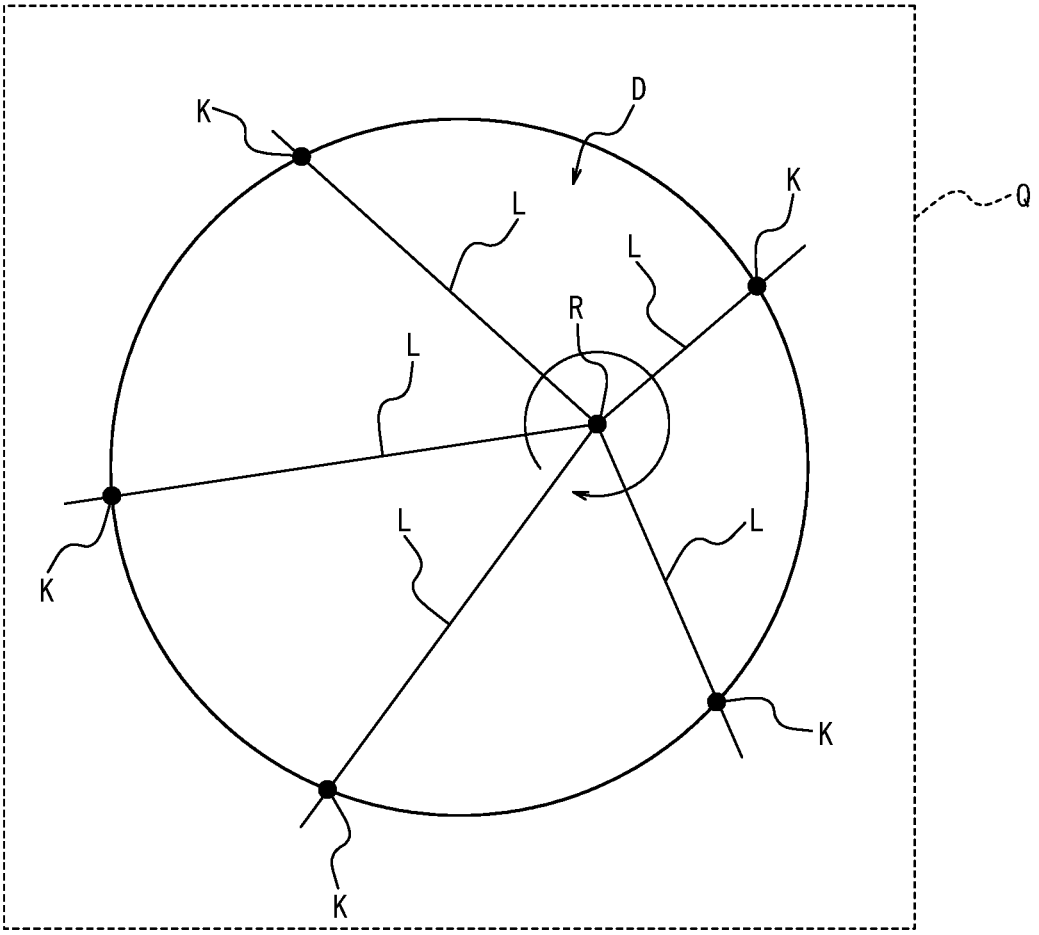
FIG. 8 illustrates the dimple contour.

Here, the contour of the dimple D will be described with reference to FIGS. 7 and 8. FIG. 7 is a sectional view schematically illustrating one of the dimples D, and FIG. 8 is a plan view schematically illustrating the dimple D. Herein, the contour of the dimple D is determined as follows. Firstly, as illustrated in FIG. 7, a virtual plane Q is placed on the dimple D. At this time, depending on a three-dimensional shape of the dimple D, the dimple D can come into contact with the virtual plane Q over an entire circumference of the dimple D, or the dimple D can come into contact with the virtual plane Q only at a portion of the dimple D in the circumferential direction. Secondly, on the virtual plane Q, a linear scanning line L is drawn from any point R within the range of the dimple D on the virtual plane Q toward the outer side in the circumferential direction of the dimple D. Then, for each of different points on the scanning line L, a height h from a deepest point M on the surface of the golf ball along a perpendicular line of the virtual plane Q that passes through the point is measured, and a point at which the height h is maximum is defined as a peak K. The deepest point M is a point in different points on the surface of the golf ball (including the surface of the dimple D) at which a distance from the scanning line L in the direction of the perpendicular line of the virtual plane Q is maximum. This means that different scanning lines L have different deepest points M. Then, as illustrated in FIG. 8, while the scanning line L 360° is rotated about the above point R, the peak K is similarly taken at different positions in the circumferential direction. An annular line formed by projecting the individual peaks K onto the virtual plane Q is defined as the contour of the dimple D.

In the examples described herein, from the perspective of increasing the flight distance, a depth H of a dimple D having a smallest depth H (FIG. 2) in the multiple dimples D included in the golf ball 1 may be, but is not particularly limited to, preferably not less than 0.070 mm, and more preferably not less than 0.090 mm. Similarly, from the perspective of increasing the flight distance, a depth H of a dimple D having a largest depth H in the multiple dimples D included in the golf ball 1 may be, but is not particularly limited to, preferably not more than 0.300 mm, more preferably not more than 0.200 mm, and more preferably not more than 0.158 mm. Note that, as illustrated in FIG. 2, the depth H of a dimple D refers to a distance from an opening edge surface VP of the dimple D to a deepest point P of the dimple D. The opening edge surface VP of the dimple D is a virtual plane surrounded by a dimple edge E. The dimple edge E refers to an opening edge of the dimple D, that is, an annular edge located at the boundary between the dimple D and the land N. Additionally, if a position of the dimple edge E in the radial direction (height) is not uniform along the circumferential direction of the dimple edge E, the opening edge surface VP of the dimple D is defined as being located at an average position of the dimple edge E in the radial direction (average height). The deepest point P of the dimple D refers to a point farthest from the opening edge surface VP of the dimple D in the radial direction. Herein, the "radial direction" refers to a radial direction of the golf ball 1 that passes through the center of the dimple D.

In the examples described herein, from the perspective of increasing the flight distance, a volume of the dimple D having a smallest volume in the multiple dimples D included in the golf ball 1 may be, but is not particularly limited to, preferably not less than 0.150 $mm^3$, and more preferably not less than 0.230 $mm^3$. Additionally, from the perspective of increasing the flight distance, a volume of the dimple D having a largest volume in the multiple dimples D included in the golf ball 1 may be, but is not particularly limited to, preferably not more than 1.250 $mm^3$, and more preferably not more than 1.180 $mm^3$.

Note that the volume of a dimple D refers to a volume space surrounded by the wall surface of the dimple D and the opening edge surface VP of the dimple D.

In the examples described herein, from the perspective of increasing the flight distance, a total number of the dimples D included in the golf ball 1 may be, but is not particularly limited to, preferably not less than 250, more preferably not less than 300, even more preferably not less than 320, still more preferably not less than 326, and even still more preferably not less than 330. Similarly, from the perspective of increasing the flight distance, the total number of the dimples D increased in the golf ball 1 may be, but is not particularly limited to, preferably not more than 440, more preferably not more than 400, even more preferably not more than 360, and still more preferably not more than 338.

In the examples described herein, from the perspective of increasing the flight distance, a dimples' surface occupancy SR (%) in the golf ball 1 is preferably not less than 70.00%, more preferably not less than 76.00%, and even more preferably not less than 82.30%. Similarly, from the perspective of increasing the flight distance, the dimples' surface occupancy SR (%) in the golf ball 1 is preferably not more than 90.00%, more preferably not more than 86.00%, even more preferably not more than 84.60%, and particularly more preferably not more than 82.75%.

Note that the dimples' surface occupancy SR (%) in the golf ball 1 refers to a ratio of a total area of the respective opening edge surfaces VP of the dimples with respect to an area of a virtual spherical surface VS of the golf ball 1 (FIG. 2). The virtual spherical surface VS of the golf ball 1 is a spherical surface forming a contour of the golf ball 1 when it is assumed that the golf ball 1 does not include any dimple D (i.e., when it is assumed that the golf ball 1 is a perfect sphere).

In the examples described herein, from the perspective of increasing the flight distance, a dimples' spatial occupancy VR (%) in the golf ball 1 is preferably not less than 0.600%, more preferably not less than 0.700%, even more preferably not less than 0.731%, and particularly more preferably not less than 0.746%. Similarly, from the perspective of increasing the flight distance, the dimples' spatial occupancy VR (%) in the golf ball 1 is preferably not more than 1.200%, more preferably not more than 1.000%, even more preferably not more than 0.800%, and still more preferably not more than 0.771%, and particularly more preferably not more than 0.767%.

Note that the dimples' spatial occupancy VR (%) in the golf ball 1 refers to a ratio of a total volume of the dimples D with respect to a volume of space surrounded by the virtual spherical surface VS of the golf ball 1 (FIG. 2).

In the examples described herein, a diameter of the golf ball 1 may be appropriately set according to the Rules of golf, and is preferably not less than 42.67 mm. Further, the diameter of the golf ball 1 is preferably not more than 44.00 mm, and more preferably not more than 42.80 mm.

In the examples described herein, a mass of the golf ball 1 may be appropriately set according to the Rules of golf, and is, for example, preferably not less than 40.00 g, more preferably not less than 44.00 g, and even more preferably not less than 45.00 g. Further, the mass of the golf ball 1 is preferably not more than 45.93 g.

In the examples described herein, the core 10 of the golf ball 1 is formed of polybutadiene as a main material. An amount of deflection from a state in which an initial load of 98 N (10 kgf) is applied to the core 10 to a state in which a final load of 1275 N (130 kgf) is applied to the core 10 may be, but is not particularly limited to, not less than 2.0 mm. Further, an upper limit of the amount of deflection may be, but is not particularly limited to, not more than 5.0 mm.

In the examples described herein, examples of materials preferably used in the intermediate layer 20 and/or the cover 30 of the golf ball 1 may include, but are not particularly limited to, ionomer resin, thermoplastic elastomer, thermosetting elastomer. Examples of thermoplastic elastomer may include various types of thermoplastic elastomer, such as polyester-based, polyamide-based, polyurethane-based, olefin-based, or styrene-based thermoplastic elastomer.

In the examples described herein, a hardness of a material of the intermediate layer 20 and/or a hardness of the material of the cover 30 in the golf ball 1 may be, but are/is not particularly limited to, not less than 30 in Shore D hardness. Further, an upper limit of the hardness/hardnesses may be, but are/is not particularly limited to, not more than 80 in Shore D hardness.

Herein, the "hardness of a material" is a hardness obtained by stacking the material to a thickness of not less than 6 mm and conducting measurement using a type D durometer in accordance with ASTM D2240.

In the examples described herein, a thickness of the intermediate layer 20 and/or a thickness of the cover 30 in the golf ball 1 may be, but are/is not particularly limited to, 0.3 to 3.0 mm.

In the examples described herein, the surface of the golf ball 1 may have a variety of coatings, such as white enamel coatings, epoxy coatings, and/or clear coatings.

In the examples described herein, a mold used for molding the golf ball 1 may be produced by using a 3DCAD•CAM and by using a method of directly cutting an entire surface pattern three-dimensionally into a master mold which is to be reversed, a method of directly cutting a cavity portion (inner wall surface) of the mold used for molding three-dimensionally, or the like.

Examples

Examples 1 to 4 and Comparative Examples 1 to 5 of a golf ball of the present disclosure, which were experimentally manufactured and evaluated, will be described with reference to Tables 1 to 3 and FIGS. 3 to 6.

Table 1 shows specifications of dimples of Examples 1 and 2 and Comparative Examples 1 and 2. Table 2 shows specifications of dimples of Example 3 and Comparative Examples 3 to 5. In Tables 1 and 2, specifications of dimples of Example 4 are omitted. Table 3 shows additional specifications and evaluation results of dimples of Examples 1 to 4 and Comparative Examples 1 to 5.

Figure 3A:
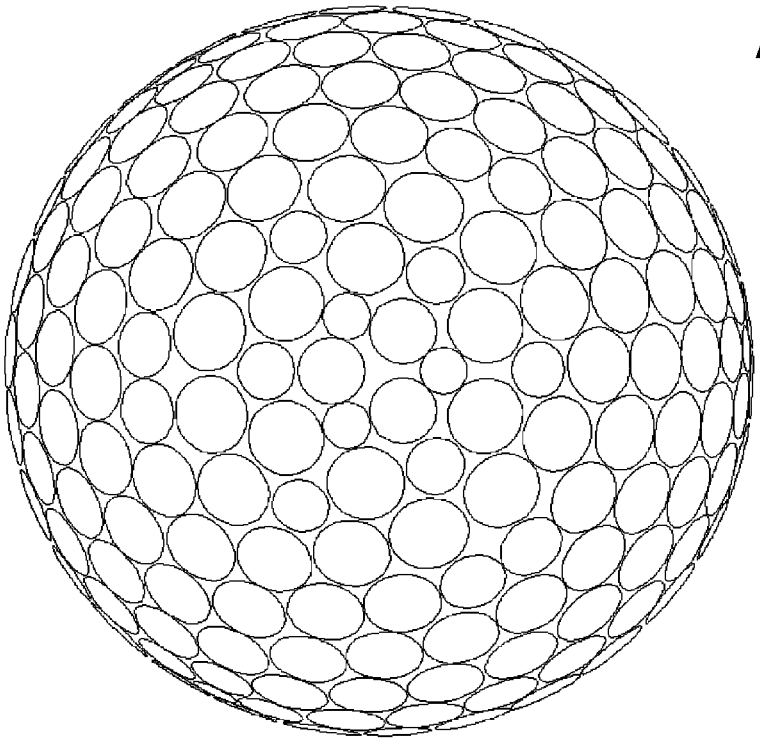
FIGS. 3A and 3B illustrate golf balls according to Examples 1 and 2 and Comparative Examples 1 and 2, with FIG. 3A viewed from a pole side, and with FIG. 3B viewed from a seam side.
Figure 3B:
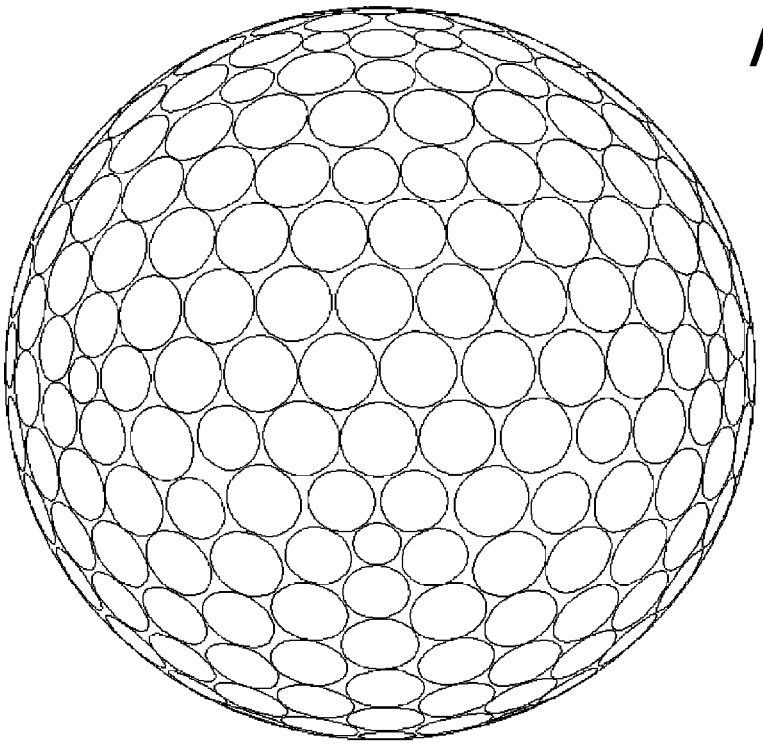
Figure 4A:
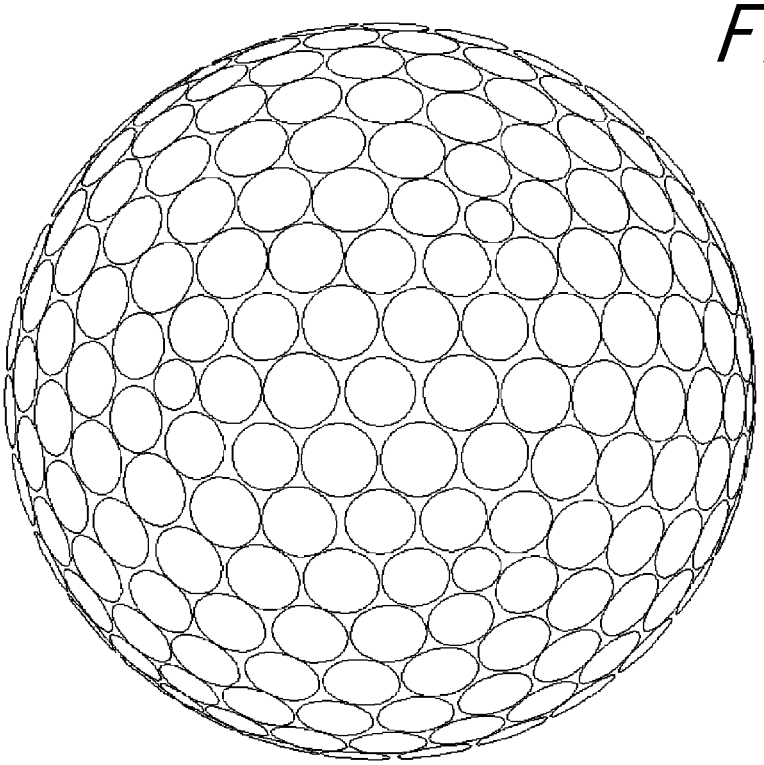
FIG. 4A and FIG. 4B illustrate golf balls according to Example 3 and Comparative Example 3, with FIG. 4A viewed from the pole side, and with FIG. 4B viewed from the seam side.
Figure 4B:
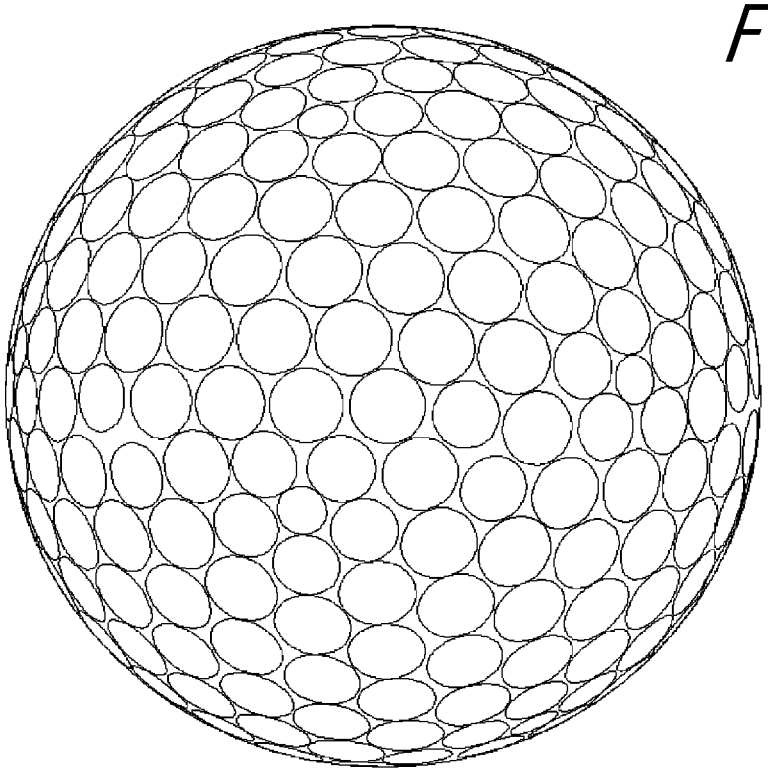
Figure 5A:
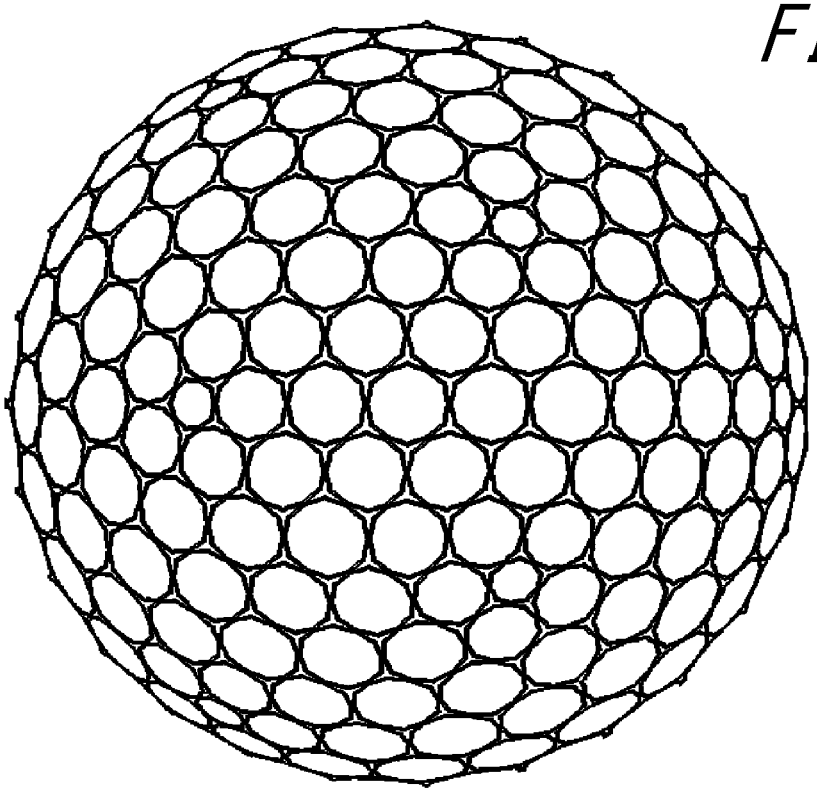
Figure 5B:
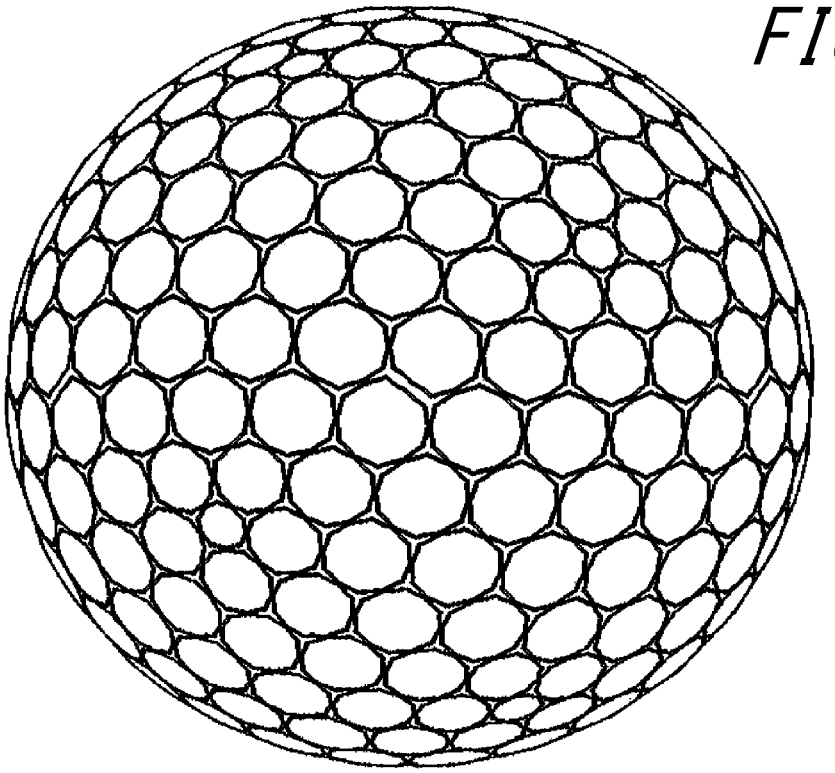
Figure 6A:
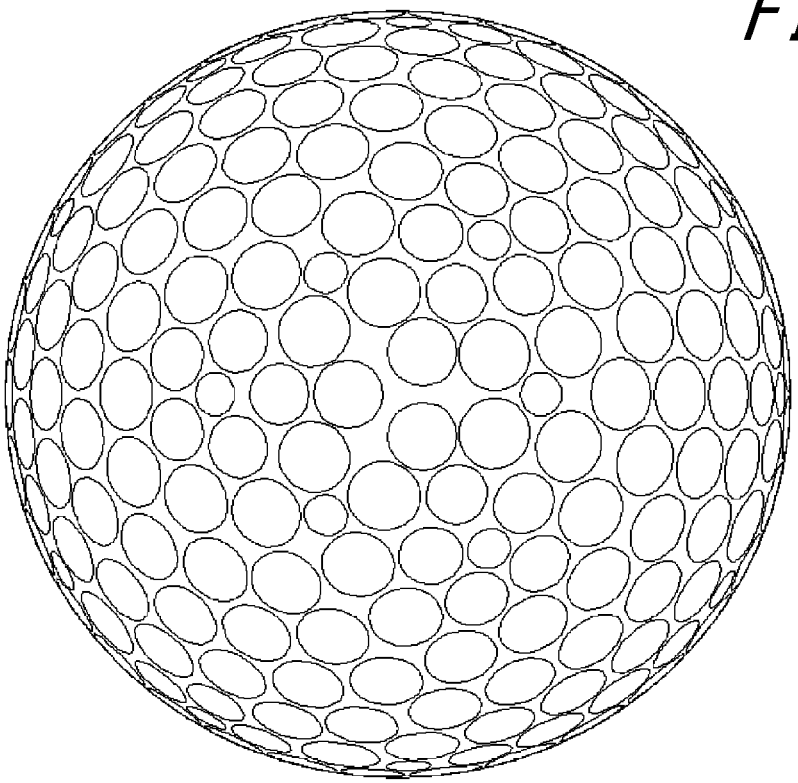
FIG. 6A and FIG. 6B illustrate golf balls according to Comparative Examples 4 and 5, with FIG. 6A viewed from the pole side, and with FIG. 6B viewed from the seam side.
Figure 6B:
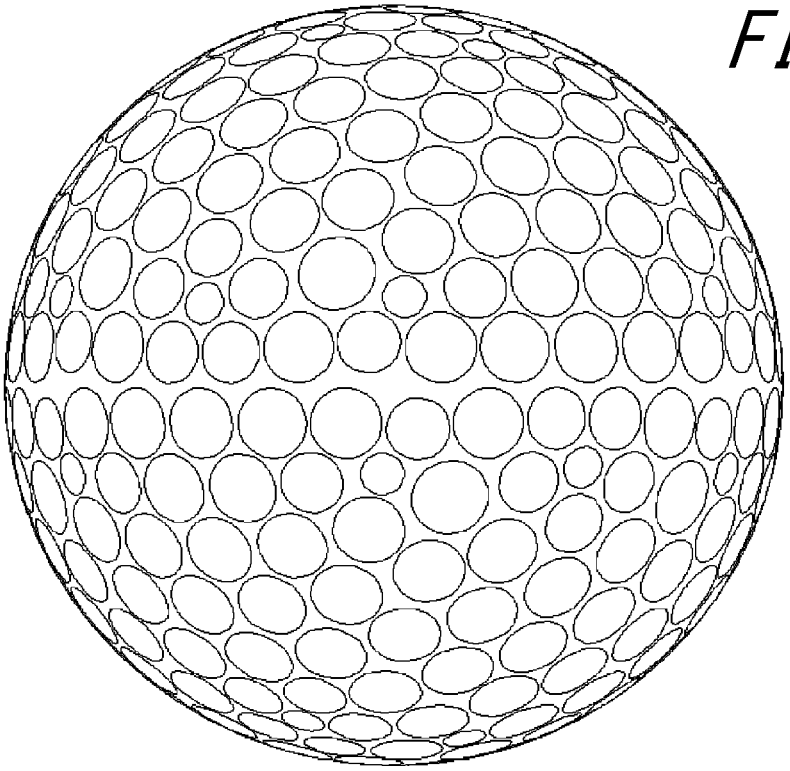

FIGS. 3A and 3B illustrate Examples 1 and 2 and Comparative Examples 1 and 2, with FIG. 3A viewed from a pole side, and FIG. 3B viewed from a seam side. FIGS. 4A and 4B illustrate Example 3 and Comparative Example 3, with FIG. 4A viewed from the pole side, and with FIG. 4B viewed from the seam side. FIGS. 5A and 5B illustrate Example 4, with FIG. 5A viewed from the pole side, and with FIG. 5B viewed from the seam side. FIGS. 6A and 6B illustrate Comparative Examples 4 and 5, with FIG. 6A viewed from the pole side, and with FIG. 6B viewed from the seam side.

[Evaluation Method]

To evaluate the golf ball of each example, a driver (W #1) was mounted on a swing robot to strike the golf ball, and a carry (y) and a total (y) were measured. The following striking conditions were set for the golf ball: an initial speed of 72 m/s; a spin rate of 2500 rpm; and a launch angle of approximately 10°. A golf club used was "TOURB XD-3" (loft angle 9.5°) manufactured by Bridgestone Sports Co., Ltd. At the test, it was almost windless. Averages of measured values obtained by 20 measurements are shown in Table 3 as evaluation results.

TABLE 1

Specifications of Dimples

| Example | Type | Number | Diameter (mm) | Depth (mm) | Volume ($mm^3$) |
|---|---|---|---|---|---|
| 1 | 1 | 12 | 4.60 | 0.123 | 1.047 |
| | 2 | 198 | 4.45 | 0.122 | 0.995 |
| | 3 | 36 | 3.85 | 0.119 | 0.675 |
| | 4 | 12 | 2.75 | 0.090 | 0.319 |
| | 5 | 36 | 4.45 | 0.136 | 1.071 |
| | 6 | 24 | 3.85 | 0.133 | 0.870 |
| | 7 | 6 | 3.40 | 0.118 | 0.613 |
| | 8 | 6 | 3.30 | 0.118 | 0.580 |
| Example 2 | 1 | 12 | 4.60 | 0.137 | 1.180 |
| | 2 | 198 | 4.45 | 0.136 | 1.036 |
| | 3 | 36 | 3.85 | 0.124 | 0.727 |
| | 4 | 12 | 2.75 | 0.100 | 0.266 |
| | 5 | 36 | 4.45 | 0.150 | 1.099 |
| | 6 | 24 | 3.85 | 0.134 | 0.753 |
| | 7 | 6 | 3.40 | 0.115 | 0.558 |
| | 8 | 6 | 3.30 | 0.115 | 0.526 |
| Comparative Example 1 | 1 | 12 | 4.60 | 0.118 | 1.061 |
| | 2 | 198 | 4.45 | 0.117 | 0.981 |
| | 3 | 36 | 3.85 | 0.114 | 0.702 |

TABLE 1-continued

Specifications of Dimples

| Example | Type | Number | Diameter (mm) | Depth (mm) | Volume ($mm^3$) |
|---|---|---|---|---|---|
| | 4 | 12 | 2.75 | 0.085 | 0.236 |
| | 5 | 36 | 4.45 | 0.126 | 1.060 |
| | 6 | 24 | 3.85 | 0.123 | 0.761 |
| | 7 | 6 | 3.40 | 0.115 | 0.558 |
| | 8 | 6 | 3.30 | 0.115 | 0.526 |
| Comparative Example 2 | 1 | 12 | 4.60 | 0.139 | 1.136 |
| | 2 | 198 | 4.45 | 0.133 | 1.000 |
| | 3 | 36 | 3.85 | 0.117 | 0.673 |
| | 4 | 12 | 2.75 | 0.112 | 0.326 |
| | 5 | 36 | 4.45 | 0.145 | 1.125 |
| | 6 | 24 | 3.85 | 0.142 | 0.786 |
| | 7 | 6 | 3.40 | 0.118 | 0.613 |
| | 8 | 6 | 3.30 | 0.118 | 0.580 |

TABLE 2

Specifications of Dimples

| | Type | Number | Diameter (mm) | Depth (mm) | Volume ($mm^3$) |
|---|---|---|---|---|---|
| Example 3 | 1 | 204 | 4.40 | 0.136 | 0.985 |
| | 2 | 48 | 3.90 | 0.141 | 0.820 |
| | 3 | 12 | 2.90 | 0.142 | 0.438 |
| | 4 | 36 | 4.30 | 0.151 | 1.062 |
| | 5 | 24 | 3.90 | 0.158 | 0.852 |
| | 6 | 14 | 4.00 | 0.130 | 0.725 |
| Comparative Example 3 | 1 | 204 | 4.40 | 0.136 | 0.942 |
| | 2 | 48 | 3.90 | 0.135 | 0.790 |
| | 3 | 12 | 2.90 | 0.100 | 0.441 |
| | 4 | 36 | 4.30 | 0.150 | 1.064 |
| | 5 | 24 | 3.90 | 0.160 | 0.877 |
| | 6 | 14 | 4.00 | 0.120 | 0.779 |
| Comparative Example 4 | 1 | 198 | 4.10 | 0.155 | 0.872 |
| | 2 | 6 | 3.85 | 0.155 | 0.772 |
| | 3 | 54 | 3.55 | 0.149 | 0.624 |
| | 4 | 30 | 2.70 | 0.151 | 0.331 |
| | 5 | 12 | 4.35 | 0.151 | 0.991 |
| | 6 | 42 | 4.05 | 0.169 | 0.928 |
| | 7 | 24 | 3.60 | 0.169 | 0.710 |
| | 8 | 6 | 3.50 | 0.147 | 0.670 |
| Comparative Example 5 | 1 | 198 | 4.10 | 0.163 | 0.989 |
| | 2 | 6 | 3.85 | 0.151 | 0.827 |
| | 3 | 54 | 3.55 | 0.149 | 0.682 |
| | 4 | 30 | 2.70 | 0.136 | 0.313 |
| | 5 | 12 | 4.35 | 0.160 | 1.168 |
| | 6 | 42 | 4.05 | 0.190 | 1.168 |
| | 7 | 24 | 3.60 | 0.174 | 0.806 |
| | 8 | 6 | 3.50 | 0.166 | 0.787 |

TABLE 3

Specifications of Dimples and Evaluation Results

| | Example 1 | Example 2 | Comparative Example 1 | Comparative Example 2 | Example 3 | Comparative Example 3 | Example 4 | Comparative Example 4 | Comparative Example 5 |
|---|---|---|---|---|---|---|---|---|---|
| Figure | FIG. 3 | FIG. 3 | FIG. 3 | FIG. 3 | FIG. 4 | FIG. 4 | FIG. 5 | FIG. 6 | FIG. 6 |
| Total number of dimples | 330 | 330 | 330 | 330 | 338 | 338 | 326 | 372 | 372 |
| SR (%) | 82.30 | 82.30 | 82.30 | 82.30 | 82.75 | 82.75 | 84.60 | 77.30 | 77.30 |
| VR (%) | 0.746 | 0.767 | 0.731 | 0.751 | 0.771 | 0.750 | 0.731 | 0.718 | 0.820 |
| CL2/CL1 | 1.018 | 0.999 | 0.930 | 0.947 | 1.022 | 0.978 | 1.044 | 0.478 | 0.898 |
| CL4/CL3 | 1.262 | 1.277 | 1.261 | 1.286 | 1.280 | 1.285 | 1.252 | 1.369 | 1.301 |
| Carry (y) | 273 | 271 | 269 | 267 | 271 | 269 | 271 | 263 | 263 |
| Total (y) | 285 | 282 | 277 | 273 | 284 | 277 | 284 | 266 | 268 |

As can be seen from the results shown in Table 3, the golf balls of Examples demonstrate increased flight distances compared with the golf balls of Comparative Examples.

A golf ball according to the present disclosure may be utilized for any kind of golf balls and preferably utilized for, for example, a one-piece golf ball, a two-piece golf ball, a three-piece golf ball, a four-piece golf ball, a five-piece golf ball, a six-piece golf ball, a thread-wound golf ball, etc.

The invention claimed is:

1. A golf ball comprising a surface having multiple dimples thereon, wherein, each of the multiple dimples has a depth of not more than 0.158 mm, and when a lift coefficient measured under conditions with a Reynolds number of 80000 and a spin rate of 2000 rpm is CL1, and when a lift coefficient measured under conditions with a Reynolds number of 70000 and a spin rate of 1900 rpm is CL2, CL1 and CL2 satisfy $$1.018 \leq CL2/CL1 \leq 1.044.$$

2. The golf ball according to claim 1, wherein when a lift coefficient measured under conditions with a Reynolds number of 200000 and a spin rate of 2500 rpm is CL3, and when a lift coefficient measured under conditions with a Reynolds number of 120000 and a spin rate of 2250 rpm is CL4, CL3 and CL4 satisfy $$1.250 \leq CL4/CL3 \leq 1.280.$$

3. The golf ball according to claim 1, wherein

CL1 is not less than 0.230 and not more than 0.240, and

CL2 is not less than 0.230 and not more than 0.240.

4. The golf ball according to claim 2, wherein

CL3 is not less than 0.145 and not more than 0.155, and

CL4 is not less than 0.185 and not more than 0.195.

* * * * *